US011336983B1

(12) United States Patent
Ji et al.

(10) Patent No.: US 11,336,983 B1
(45) Date of Patent: May 17, 2022

(54) RECEIVER MODULE HAVING PRESSURE EQUILIBRIUM STRUCTURE

(71) Applicant: EM-TECH Co., Ltd., Gyeongsangnam-do (KR)

(72) Inventors: Yong Ju Ji, Gyeongsangnam-do (KR); Jung Ho Kang, Gyeongsangnam-do (KR); Byung Jin Park, Gyeongsangnam-do (KR)

(73) Assignee: EM-TECH CO., LTD., Gyeongsangnam-Do (KR)

( * ) Notice: Subject to any disclaimer, the term of this patent is extended or adjusted under 35 U.S.C. 154(b) by 0 days.

(21) Appl. No.: 17/204,997

(22) Filed: Mar. 18, 2021

(51) Int. Cl.
*H04R 1/10* (2006.01)
*H04R 31/00* (2006.01)
*H04R 9/02* (2006.01)

(52) U.S. Cl.
CPC ..... *H04R 1/1016* (2013.01); *H04R 9/025* (2013.01); *H04R 31/00* (2013.01); *H04R 2460/11* (2013.01)

(58) Field of Classification Search
CPC combination set(s) only.
See application file for complete search history.

(56) References Cited

U.S. PATENT DOCUMENTS 10,623,847 B2 * 4/2020 Jiang ..... H04R 1/1075
11,082,768 B2 * 8/2021 Ong ..... H04R 1/2803

FOREIGN PATENT DOCUMENTS

JP 2019047406 A 3/2019
KR 101194923 B1 10/2012
KR 20140136184 A 11/2014
KR 101558091 B1 10/2015

* cited by examiner

*Primary Examiner* — Angelica M McKinney
(74) *Attorney, Agent, or Firm* — Murphy, Bilak & Homiller, PLLC

(57) ABSTRACT

Disclosed is a receiver module including: a casing including an upper casing having a sound insulation hole and a lower casing coupled to the upper casing and having a ventilation hole; a receiver installed in an internal space defined by the casing and having a frame, a magnetic circuit, a voice coil, and a diaphragm; and an air module disposed to surround a lower surface and an outer circumference of the receiver, fixed to an inner circumference of the casing, and having an air path connecting the sound insulation hole and the ventilation hole.

8 Claims, 4 Drawing Sheets

RECEIVER MODULE HAVING PRESSURE EQUILIBRIUM STRUCTURE

TECHNICAL FIELD

The present disclosure relates to a receiver module having a pressure equilibrium structure.

BACKGROUND

Earphones are classified into a closed earphone in which the rest of the earphone is blocked except for a sound radiating hole inserted into an ear canal and an open earphone including a tuning hole and a duct in addition to the sound radiating hole.

The closed earphone, which transmits a sound of a receiver installed therein directly into a user's ear, enables the user to hear a sound even with small power, and in particular, a canal-type earphone inserted into the user's ear through an earpiece has the advantage of excellent sound insulation to block ambient noise.

However, in the case of a canal-type earphone, a difference in atmospheric pressure between the inside and outside of the ear canal occurs as an ear canal is completely sealed, and thus ears may become deaf or some people may feel uncomfortable. Korean Patent Registration No. 10-1558091 discloses a canal-type earphone including a pressure equilibrium means to improve the pressure difference.

FIG. 1 is a view showing a canal-type earphone including a pressure equilibrium means according to the related art. A canal-type earphone 1*a* according to the related art includes a speaker unit 10, a housing 20 accommodating the speaker unit 10, and an earpiece 23 installed on an outer surface of a tube 25 integrally formed on a front portion of the housing 20. The speaker unit 10 installed in the housing 20 includes a cylindrical frame 11, a magnetic circuit 12 installed in the frame 11, and a diaphragm 13 that vibrates up and down by a magnetic force of the magnetic circuit 12. The frame 11 has a cylindrical shape and includes a cover 18 installed at a front and a bracket 19 installed at a rear. A through hole 18*a* is provided at the center of the cover 18 to emit sound generated in the diaphragm 13 forward. In addition, a through hole 19*a* is provided at the center of the bracket 19 to discharge the sound generated in the diaphragm 13 to the rear. Further, a through hole 16*a* is provided at the center of a yoke 16 to emit the sound generated in the diaphragm 13 to the rear.

A gasket 30 is installed on a front surface of the cover 18. The gasket 30 is formed of an elastic material such as rubber or silicone. In addition, a through hole 30*a* is provided at the center of the gasket 30 to discharge sound emitted from the speaker unit 10.

A pressure equilibrium means for discharging air present at the front of the speaker unit 10 to the rear of the speaker unit 10 to eliminate a pressure difference between the user's ear canal and ambient air is provided. The pressure equilibrium means of the earphone according to the related art includes a side air passage 50 for discharging air inside A the tube 25 or air inside B the speaker unit 10 to a side surface C of the gasket 30 or a side surface D of the speaker unit 10 and a rear air passage 60 for discharging air on the side surface C of the gasket 30 or the side surface D of the speaker unit 10 to the rear E of the speaker unit 10.

However, in the case of the canal-type earphone 1*a*, if the ear canal is not completely sealed when worn, a sound pressure inevitably decreases in a low frequency range. Therefore, development of a structure capable of compensating for a decrease in sound pressure in the low frequency range, while improving deafening of the canal-type earphone by providing an air passage is required.

SUMMARY

Therefore, an object of the present disclosure is to provide a receiver module including an air module that may be mounted outside a receiver, as a pressure equilibrium structure, without changing a structure of the receiver.

According to an aspect of the present disclosure, there is provided a receiver module including: a casing including an upper casing having a sound insulation hole and a lower casing coupled to the upper casing and having a ventilation hole; a receiver installed in an internal space defined by the casing and having a frame, a magnetic circuit, a voice coil, and a diaphragm; and an air module disposed to surround a lower surface and an outer circumference of the receiver, fixed to an inner circumference of the casing, and provided to be mountable on the receiver such that an air path connecting the sound insulation hole and the ventilation hole is selectively provided between the outer circumference of the receiver and the inner circumference of the casing.

In addition, as another example of the present disclosure, the air module may additionally define a back volume amplifying a sound through resonance at the outer circumference of the receiver.

In addition, as another example of the present disclosure, the air module may additionally include a conduit formed in the back volume and having a communication hole communicating with outside apart from the back volume.

In addition, as another example of the present disclosure, the air module may include a circular metal part surrounding the receiver and an injection-molded product part from which the metal part is insert-injected and having the air path.

In addition, as another example of the present disclosure, the receiver module may further include: a microphone for canceling active noise, wherein the microphone is located on a sound path of noise introduced through the air path so that ambient noise introduced through the ventilation hole through the air path is transferred to the microphone.

In addition, as another example of the present disclosure, the air path may connect an upper space formed between the upper casing and the receiver and a lower space formed between the lower casing and the air module, the magnetic circuit is installed in the frame of the receiver, wherein the magnetic circuit includes a cylindrical yoke coupled to the frame, a permanent magnet attached to the yoke, and a top plate attached to an upper portion of the permanent magnet, wherein the air module may be provided below the receiver frame, have a side wall formed to be spaced apart from a side wall of a yoke of the receiver, and the air path is formed at a portion protruding outward from the side wall of the air module.

Since the receiver module provided by the present disclosure includes the air module having an air path connecting an upper space of the receiver and a lower space of the receiver, thereby improving a difference in air pressure inside and outside the ear canal.

In addition, in the receiver module provided by the present disclosure, the pressure equilibrium means may be easily arranged in the module by attaching the air module outside the used receiver, without changing a structure of the receiver.

Those skilled in the art will recognize additional features and advantages upon reading the following detailed description, and upon viewing the accompanying drawings.

DETAILED DESCRIPTION

Hereinafter, the present disclosure will be described in more detail with reference to the drawings.

Figure 1:
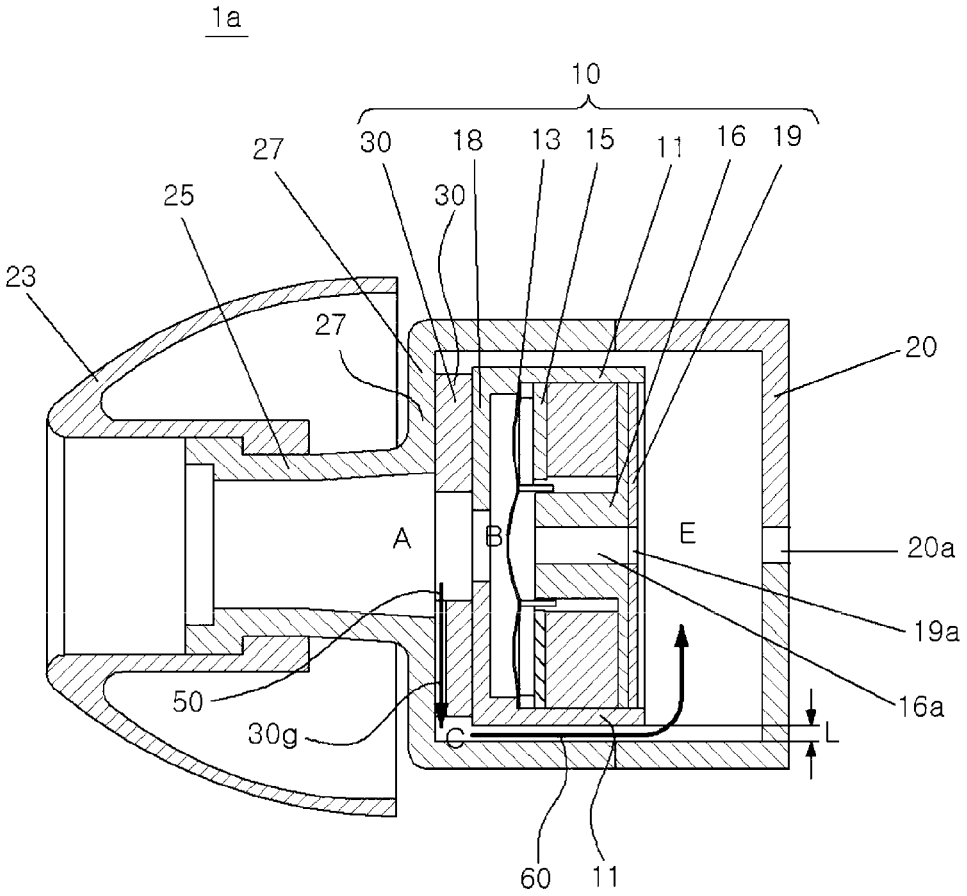
FIG. 1 is a view showing a canal-type earphone including a pressure equilibrium means according to the related art.
Figure 2:
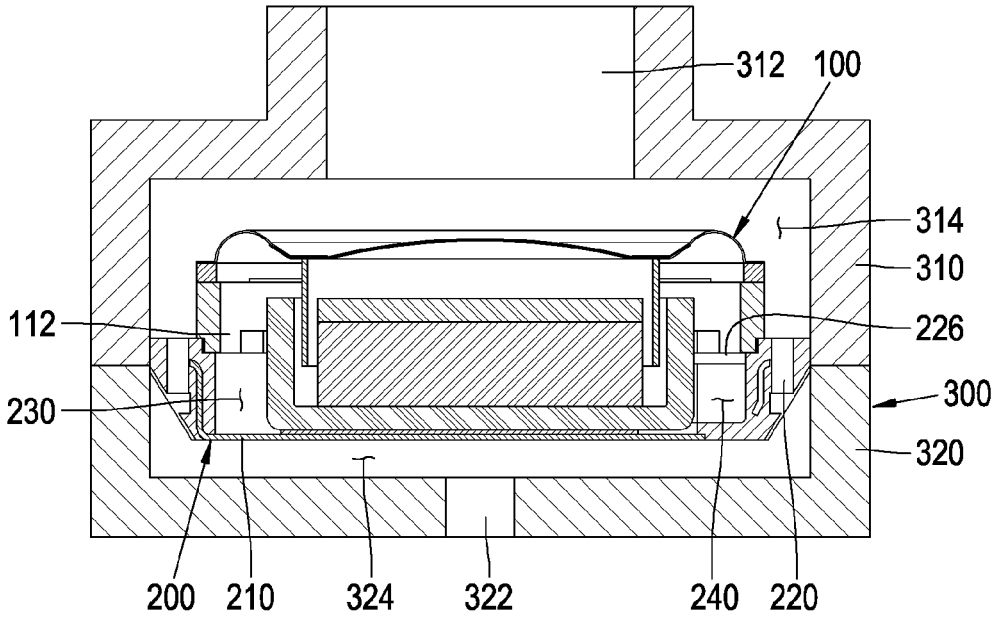
FIG. 2 is a cross-sectional view of a receiver module having a pressure equilibrium structure according to an embodiment of the present disclosure.

FIG. 2 is a cross-sectional view of a receiver module having a pressure equilibrium structure according to an embodiment of the present disclosure.

A receiver module according to an embodiment of the present disclosure includes a receiver 100, an air module 200 coupled to the outside of the receiver 100, and a casing 300 forming an exterior. The casing 300 provided in the receiver module according to an embodiment of the present disclosure includes an upper casing 310 having a sound insulation hole 312 and a lower casing 320 coupled to the upper casing 310 and having a ventilation hole 322. Spaces 314 and 324 through which air may flow exist between the upper casing 310 and the receiver 100 and between the lower casing 320 and the air module 200.

Figure 3:
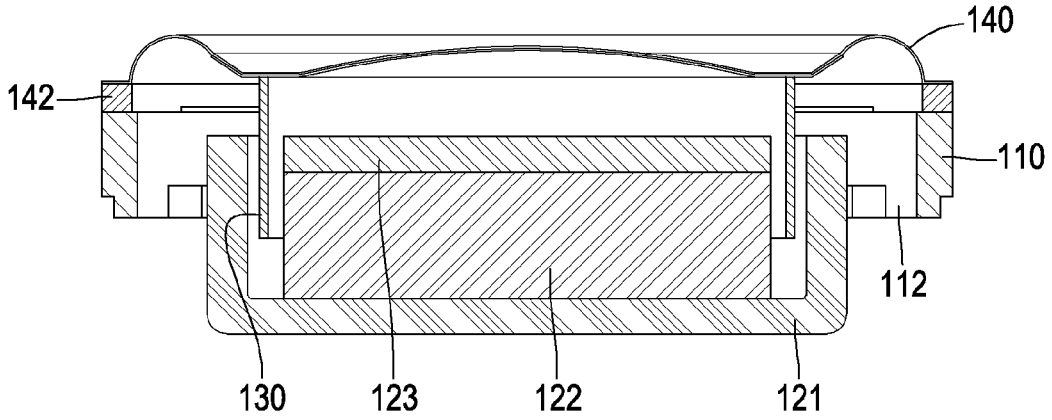
FIG. 3 is a receiver provided in a receiver module having a pressure equilibrium structure according to an embodiment of the present disclosure.

FIG. 3 is a receiver provided in a receiver module having a pressure equilibrium structure according to an embodiment of the present disclosure.

The receiver 100 includes a frame 110 for fixing parts. A magnetic circuit is installed in the frame 110, and the magnetic circuit includes a cylindrical yoke 121 coupled to the frame 110, a permanent magnet 122 attached to the yoke 121, and a top plate 123 attached to an upper portion of the permanent magnet 122. In addition, a lower end of a voice coil 130 is located in a magnetic gap formed between a side wall of the cylindrical yoke 121 and the permanent magnet 122, and an upper end of the voice coil 130 is attached to a diaphragm 140. The diaphragm 140 is seated on the frame 110, a seating ring 142 formed of an injection-molded product part having a thickness and rigidity greater than the diaphragm 140 may be attached to an outer circumference of the diaphragm 140 to aid in seating.

Meanwhile, a back hole 112 may be formed in the frame 110 so that the diaphragm 140 may smoothly vibrate.

Figure 4:
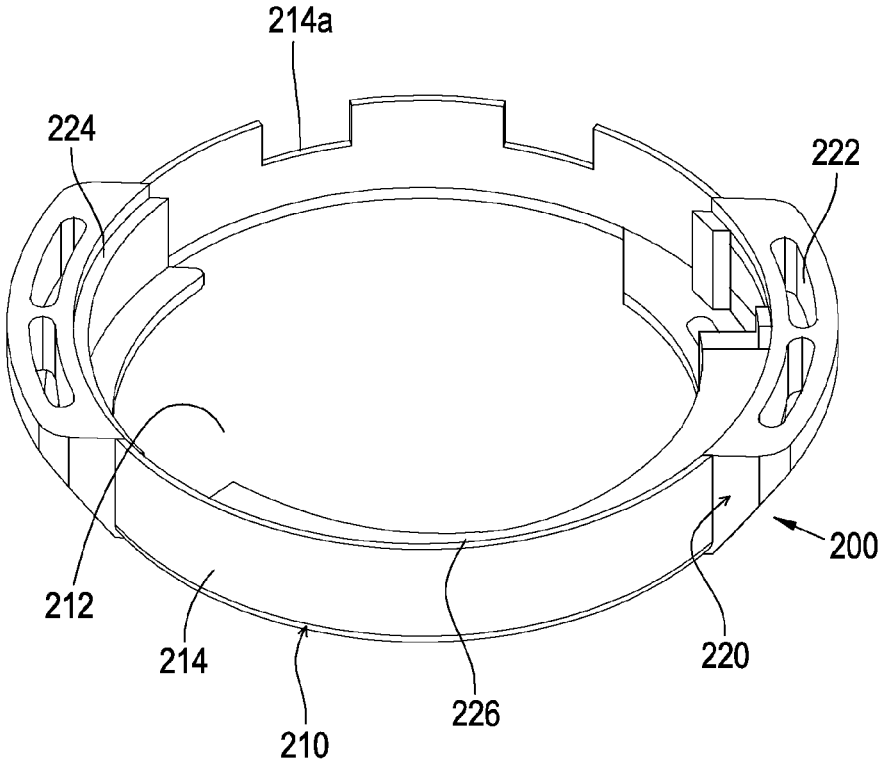
FIG. 4 is a view showing an air module of a receiver module having a pressure equilibrium structure according to an embodiment of the present disclosure.

FIG. 4 is a view showing an air module of a receiver module having a pressure equilibrium structure according to an embodiment of the present disclosure. The air module 200 is coupled to a lower side of the frame 110 of the receiver 100 and has a substantially cylindrical shape. The air module 200 includes a substantially cylindrical metal part 210 formed of an SUS material and an injection-molded product part 220 from which the metal part 210 is insert-injected. The metal part 210 includes a lower surface 212 in contact with a lower surface of the yoke 121 of the receiver 100 and a side wall 214 spaced apart from the side wall of the yoke 121 of the receiver 100. A recess **214*a* for drawing out a lead wire from the voice coil 130 may be formed in the side wall 214**.

Figure 5:
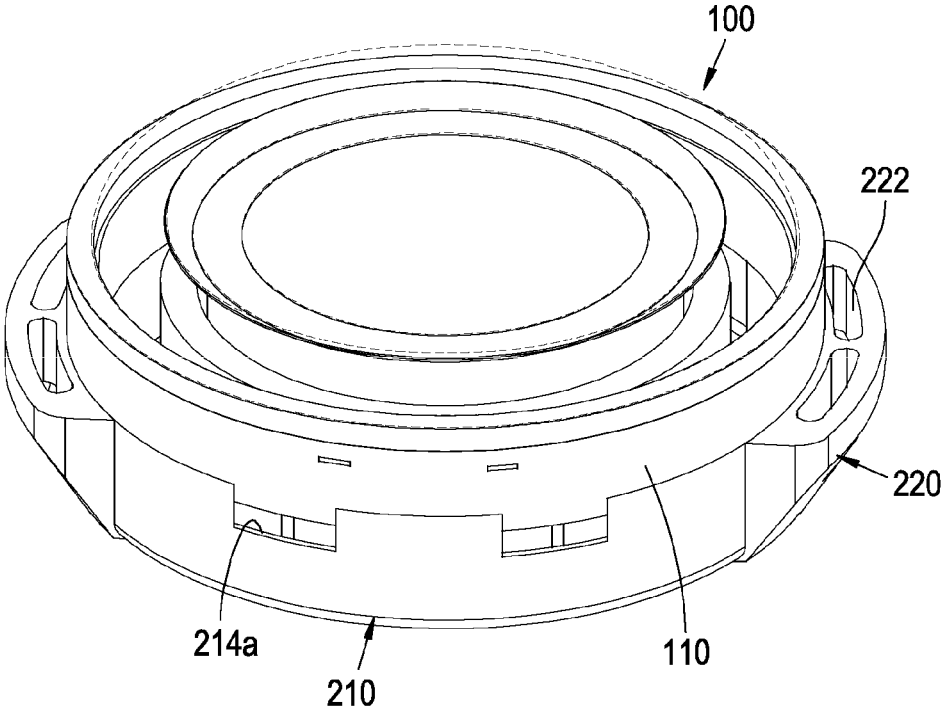
FIG. 5 is a view showing a state in which a receiver and an air module of a receiver module having a pressure equilibrium structure according to an embodiment of the present disclosure are combined.

FIG. 5 is a diagram illustrating a combination of a receiver of a receiver module having a pressure equilibrium structure and an air module according to an embodiment of the present disclosure. Referring to FIGS. 2 to 5, the injection-molded product part 220 is coupled to the metal part 210, and a pair is formed at a position facing each other, but the appearance of the injection-molded product part 220 may be changed according to design of the casing 300. An air path 222 is formed in a portion of the injection-molded product part 220 that protrudes outward from the metal part 210. The air path 222 connects an upper space 314 formed between the upper case 310 and the receiver 100 and a lower space 324 formed between the lower case 320 and the air module 200.

Meanwhile, a portion of the injection-molded product part 220 is also coupled to an inner circumferential surface of the metal part 210, and a step 224 is formed at the portion coupled to the inner circumferential surface and serves to support the frame 110 of the receiver 100.

Meanwhile, as the sidewall 214 of the metal part 210 is formed to be spaced apart from the sidewall of the yoke 121 of the receiver 100, a back volume 230 is formed between the receiver 100 and the metal part 210.

The air module 200 forms a partition 226 that partitions upper and lower portions in a partial section, thereby forming a conduit 240. The back volume 230 communicates with the back hole 112 of the receiver 100 and serves to amplify sound of the receiver 100. In addition, the conduit 240 performs a frequency tuning function to flatten a sound pressure in the entire frequency range by amplifying a sound pressure in a low frequency range, in particular. At this time, tuning of the frequency through the conduit 240 may be easily adjusted by changing a length of the partition 226 (i.e., an angle occupied by the partition in 360°). Here, the partition 226 is manufactured as an injection-molded product, may be integrally formed with the injection-molded product part 220, or may be manufactured as a separate part and insert-injected when forming the injection-molded product part 200.

In addition, the metal part 210 of the air module 200 includes a back volume communication hole (not shown) connecting the back volume 230 and a lower space 324 and a conduit communication hole (not shown) connecting the conduit 240 and the lower space 324.

Meanwhile, the receiver module may further include a microphone (not shown) for active noise canceling. The microphone (not shown) may be located on a sound path including the air path so that external noise introduced through the ventilation hole 322 may be transmitted to the microphone.

In addition, the air module 200 may be selectively applied in a manufacturing step of the receiver module. In addition, even the existing receiver model may advantageously have a pressure equilibrium structure, without changing a structure of a receiver, once the air module 200 is installed outside thereof.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A receiver module, comprising:

a casing including an upper casing having a sound insulation hole and a lower casing coupled to the upper casing and having a ventilation hole;

a receiver installed in an internal space defined by the casing and having a frame, a magnetic circuit, a voice coil, and a diaphragm; and an air module disposed to surround a lower surface and an outer circumference of the receiver, fixed to an inner circumference of the casing, and provided to be mountable on the receiver such that an air path connecting the sound insulation hole and the ventilation hole is selectively provided between the outer circumference of the receiver and the inner circumference of the casing.

2. The receiver module of claim 1, wherein the air module further defines a back volume for amplifying a sound through resonance at the outer circumference of the receiver.

3. The receiver module of claim 2, wherein the air module includes a conduit formed in the back volume and having a communication hole communicating with outside apart from the back volume.

4. The receiver module of claim 1, wherein the air module includes a circular metal part surrounding the receiver and an injection molded part from which the metal part is insert-injected and having the air path.

5. The receiver module of claim 1, further comprising:

a microphone configured to cancel active noise, wherein the microphone is located on a sound path including the air path so that ambient noise introduced through the ventilation hole through the air path is transferred to the microphone.

6. The receiver module of claim 1, wherein the air path connects an upper space formed between the upper casing and the receiver and a lower space formed between the lower casing and the air module.

7. The receiver module of claim 1, wherein the magnetic circuit is installed in the frame of the receiver, and wherein the magnetic circuit includes a cylindrical yoke coupled to the frame, a permanent magnet attached to the yoke, and a top plate attached to an upper portion of the permanent magnet.

8. The receiver module of claim 7, wherein the air module is provided below the frame of the receiver and has a side wall formed to be spaced apart from a side wall of a yoke of the receiver, and wherein the air path is formed at a portion protruding outward from the side wall of the air module.

* * * * *